US007097377B1

(12) United States Patent
Rigoni

(10) Patent No.: US 7,097,377 B1
(45) Date of Patent: Aug. 29, 2006

(54) HANDWRITING INSTRUMENT WITH STAMP

(75) Inventor: Michael Rigoni, Niedereschach/Fischbach (DE)

(73) Assignee: Rigoni Vermoegensverwaltung GmbH & Co. KG, Niedereschach-Fischbach (DE)

( * ) Notice: Subject to any disclaimer, the term of this patent is extended or adjusted under 35 U.S.C. 154(b) by 0 days.

(21) Appl. No.: 11/132,866

(22) Filed: May 19, 2005

(30) Foreign Application Priority Data

Apr. 4, 2005 (DE) ..... 10 2005 015 539

(51) Int. Cl.
*B05C 1/00* (2006.01)
*B43K 29/00* (2006.01)
*B41F 31/00* (2006.01)

(52) U.S. Cl. ..... 401/195; 401/17; 101/327

(58) Field of Classification Search ..... 401/195, 401/52, 17; 101/333, 327
See application file for complete search history.

(56) References Cited

U.S. PATENT DOCUMENTS 2,783,711 A * 3/1957 Vance ..... 101/333
3,438,716 A * 4/1969 Peters ..... 401/195
5,118,212 A * 6/1992 Shao ..... 401/195

* cited by examiner

*Primary Examiner*—David J. Walczak
(74) *Attorney, Agent, or Firm*—Akerman Senterfitt; Stephan A. Pendorf; Peter A. Chiabotti

(57) ABSTRACT

A handwriting instrument with a stamp carrier (40) with stamp pad (41) introduced from the side into the stock (10). The stamp carrier is releasably connected to a lid (20). The lid (20) is a segment of the stock (10). For this writing instrument a flexible standard refill (50) is provided, with which the aide of a guide bar (53) and further stock elements is bent and held against the inner wall of the stock (10) in such a manner, that it's central area is eccentrically displaced for providing greater space for the stamp carrier (40).

20 Claims, 7 Drawing Sheets

HANDWRITING INSTRUMENT WITH STAMP

BACKGROUND OF THE INVENTION

1. Field of the Invention

The invention concerns a handwriting instrument combined with a stamp, in which either a stamp with stamp pad or a self-impregnated stamp is integrated in the stock or, as the case may be, casing or housing, of the handwriting instrument and can be pivoted or extracted therefrom for carrying out the stamping process.

2. Related Art of the Invention

This type of handwriting instrument, generally referred to as a so-called "stamp pen", is well known for example from DE GM 77 15 261, DE GM 81 30 431, DE GM 84 18 819.

Since the stamp pad and/or the stamp requires space and the dimensions of the handwriting instrument naturally are limited, in the past only short writing cartridges or ink reservoir tubes, hereafter referred to simply as refills, with a comparatively small ink or paste reservoir, were employed.

EP 0 433 572 B1 discloses a handwriting instrument with an incorporated stamp, in which a high capacity writing cartridge, that is, a cartridge with large storage volume, is provided. In this writing instrument the stamp carrier, which can be folded out for stamping, is provided with an inked stamp on the rear end of the stock, whereby a relatively long writing instrument results.

The present inventive device is concerned with a task of providing an ergonomic writing instrument combined with a stamp, in which a conventional refill can be employed and of which the stock length does not substantially exceed the refill length.

For solving this task the invention begins with the known writing instrument, in which the stamp pad is provided with a stamp lying there—against in the longitudinal direction of the stock and a handle is used to remove the stamp carrier with stamp from a laterally or sideways open recess of the stock.

Such a handwriting instrument is basically known from DE 29 38 931 A1.

However in this writing instrument only a disadvantageously relatively short refill, here a writing tip with ink cartridge, can be employed, so that it is not suited for use with relatively longer refills, in particular ball point type refills.

SUMMARY OF THE INVENTION

For solving the set task it is proposed that in accordance with the invention handwriting instruments are so modified that a refill made of a flexible material and which extends substantially over the entire length of the stock is so positioned within the stock, that in the area of the approximately centrally located stamp pad carrier it is bent in the direction towards the inner wall of the stock. By this simple measure a refill of normal length can be employed despite the presence of the stamp. According to a further characteristic a lid is provided seated in the stock as a handle, on the inner side of which the stamp carrier with stamp is provided.

In the present invention it is, beyond this, proposed to assemble a stock from two substantially symmetrical shells, which are joined to each other by means of joining pegs and joining sleeves located on the shells, whereby the latter simultaneously serve as abutments or contact surfaces for the bent ink refill.

The present invention further provides a proposal for the further joining of these shells, according to which the shells are held together by means of a stock tip seated in the vicinity of the tip of the ink refill.

Further yet, the invention provides means for improving the manufacturability and handling of the handwriting instrument and for the stamp pad carrier or as the case may be stamp carrier.

The invention further concerns the design of the lid forming the handle.

For protection of the refill tip, as conventional, a cap seatable upon the tip of the stock is conventional, of which the particular design is the subject matter of further preferred embodiments of the invention.

This cap has on its free end a securing eye, in cooperation with which alternatively a retention clip and a ring can be employed. Therewith the writing instrument can either be held secure in the jacket or shirt pocket of the user or be carried around the neck of the user by a string or chain passing through the ring.

In both cases it is important to have a good connection of cap and stock.

Concrete details, the subject of which are the subject matter of the above briefly described claims, are in the following described in greater detail on the basis of illustrative examples, as shown in the figures.

DETAILED DESCRIPTION OF THE INVENTION

Figure 1:
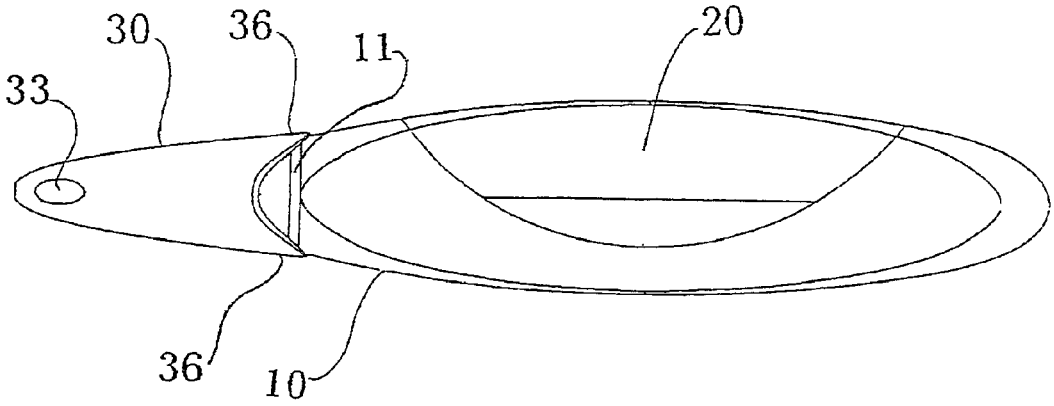
FIG. 1 side view of the writing instrument with lid serving as stamp carrier and with seated cap, FIG. 2 writing instrument according to FIG. 2 with lifted lid serving as the stamp carrier, FIG. 3 side view of the writing instrument according to FIG. 1 without cap, FIG. 4 top view of the writing instrument rotated by 90 degrees according to FIG. 3 with removed lid viewed in direction IV in FIG. 4, FIG. 5 partial section of the writing instrument according to FIG. 3 with stamp pad carrier, however without lid and refill, FIG. 6 longitudinal section of the writing instrument according to FIG. 5 with seated lid and refill, FIG. 7 perspective representation of the inner side of the lid, FIG. 8 perspective representation of the top side of the stamp carrier, FIG. 9 side view of the stamp pad carrier FIG. 10 top view of the stamp pad carrier with stamp pad, FIG. 11 enlarged view of the cap, FIG. 12 view of the cap in direction XII viewed in FIG. 11, FIG. 13 perspective representation of a cap with clip and, FIG. 14 perspective representation of the cap with ring.
Figure 2:
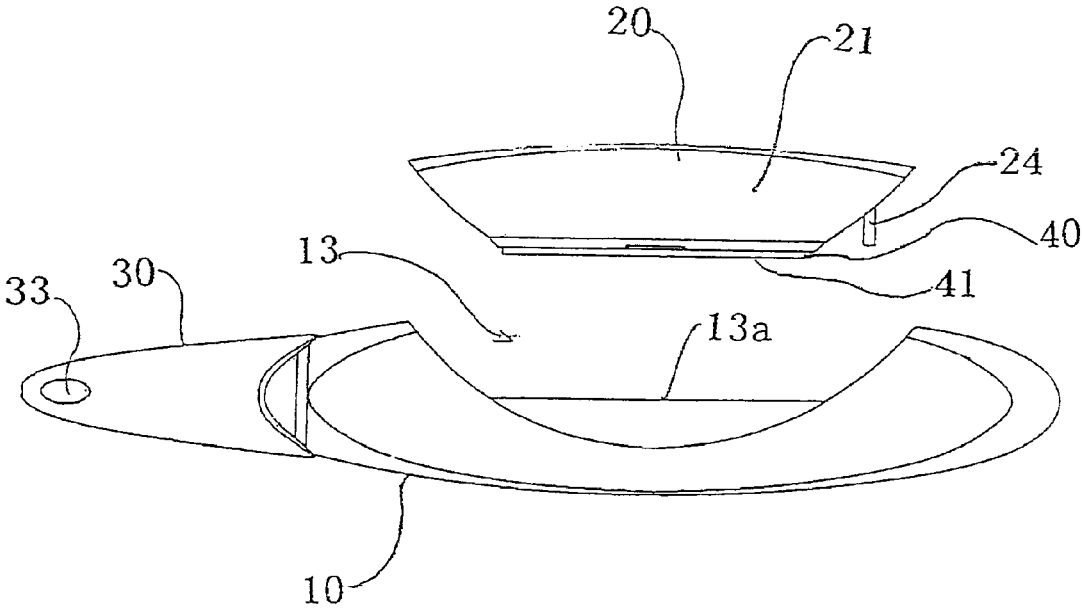
Figure 3:
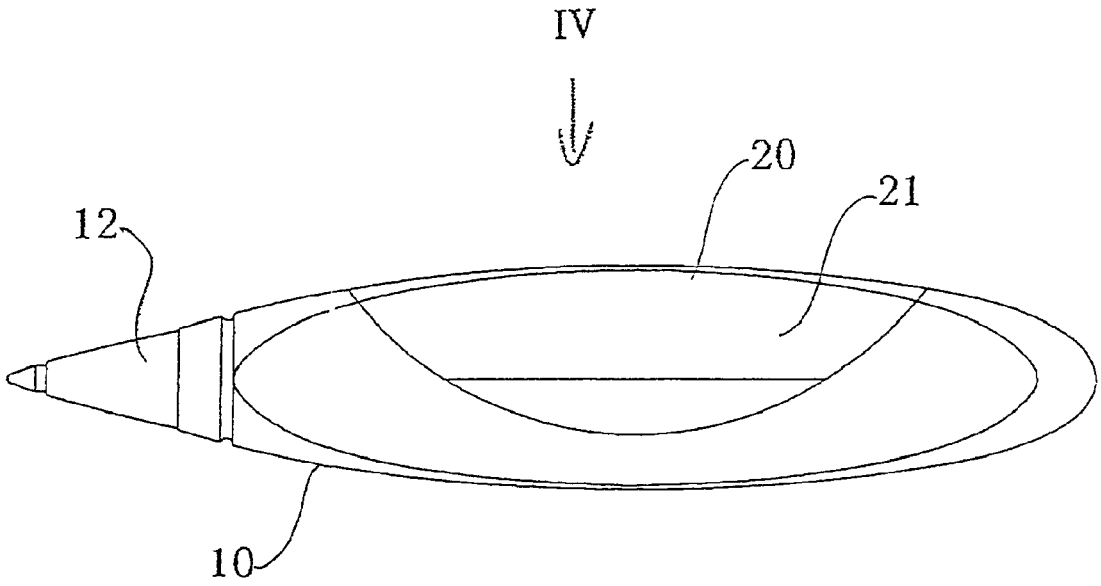

The basic design of the inventive handwriting instrument can be understood from FIGS. 1 through 3.

It is preferably comprised of a hollow housing or, as the case may be, stock 10, which has a laterally open recess 13 for the lid 20, which on its side facing towards the inside of the stock carries a stamp 41 via a stamp carrier 40. The lid 20 is so dimensioned, that its sidewall 21 extends approximately to the mid-line of the stock 10 and can be releasably connected with the edges 13*a* of the recess 13 by means of an elastic lip 25 (See FIG. 7). The lid 21 is in the shape of a segment of the stock 10 and fits contour-fittingly in the lid recess 13. For its positional fixing it projects with a detent tab 24 in a detent recess 14 recognizable in FIGS. 4 and 6. On the stock tip 12 a cap 30 is releasably seated, of which the design is explained in greater detail with reference to FIGS. 11 through 14.

Figure 4:
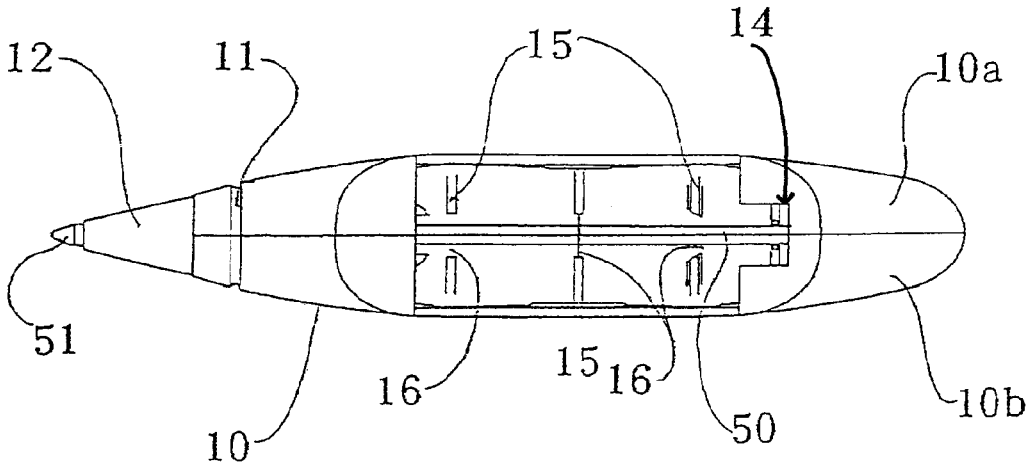
Figure 5:
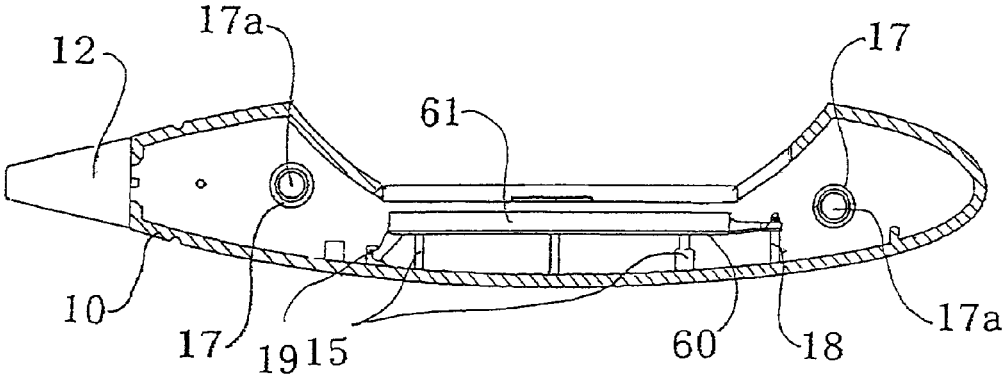
Figure 6:
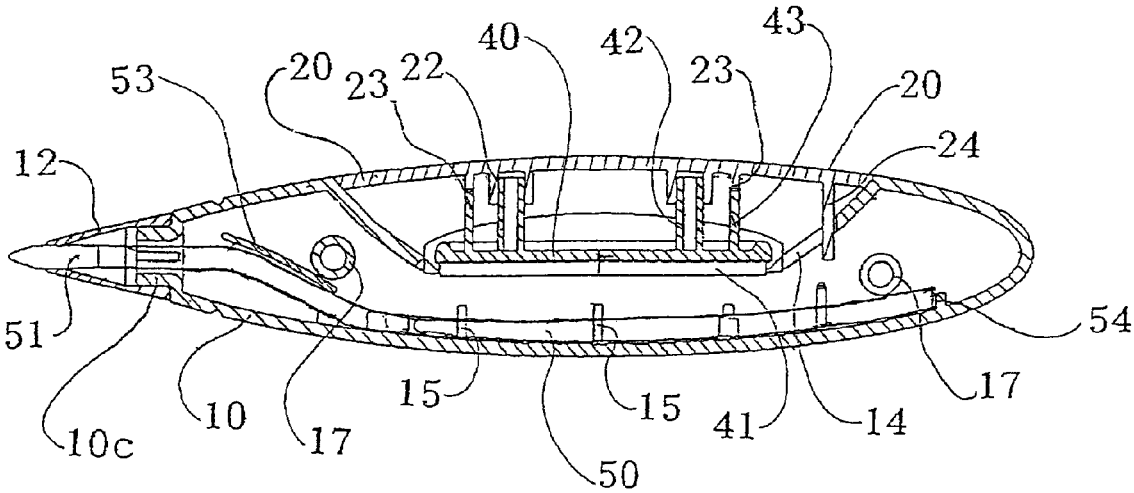
Figure 7:
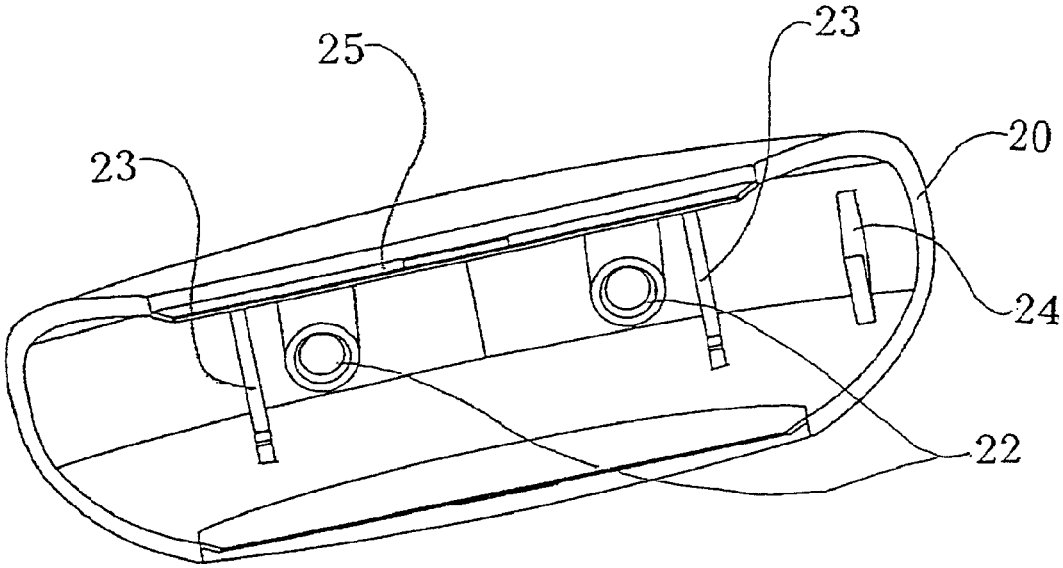

The view rotated by 90 degrees represented in FIG. 4 as well as the axial section according to FIGS. 5 and 6 allow important details of the internal construction of the writing instrument for the invention to be recognized.

Within the stock 10 a conventional refill 50 extending over almost the entire length of the stock 10 is provided, of which the refill tip 51 passes through the stock tip 12 and of which the opposite end is supported against abutment 54, as shown in FIG. 6. Since the refill lies friction fittingly against the circumference of the connecting sleeve 17, it is also secured axially in the direction of the stock tip 12, so that the refill spring, conventionally found in ball point pens, can be dispensed with, and savings can be realized.

While the refill tip 51 coaxially passes through the stock tip 12, it's ink or paste containing reservoir section is bent within the stock so as to lay against the inner wall of the stock 10, which is possible on the basis of the flexibility of the refill 50. Therein a guide bar 53, serving as bumper or deflector, ensures that the refill 50 while seated in the stock is bent out of the center against the stock inner wall.

The lateral positional securing is achieved using cross bars 15 provided spaced apart from each other in the manner of ribs of a ship hull, which laterally border the receptacle area 16.

At its back end the refill 50 lies against a sleeve 17 running transverse within the stock 10. This sleeve serves, together with the therein form fittingly engaging peg 17*a*, for the joining of the shells 10*a* and 10*b* of the double-shell stock 10, wherein the connecting sleeve 17 is part of a shell and the connecting peg 17*a* engaging therein is part of the other shell.

The tip end of the double shell stock 10 terminates in a cylindrical seat 10*c*, upon which the approximately cone-shaped stock tip 12, through which the refill tip 51 has passed, is friction-fittingly seated, which together with the connecting sleeve 17 and engaging peg 17*a* ensures the holding together of the stock shells 10*a* and 10*b*.

Figure 8:
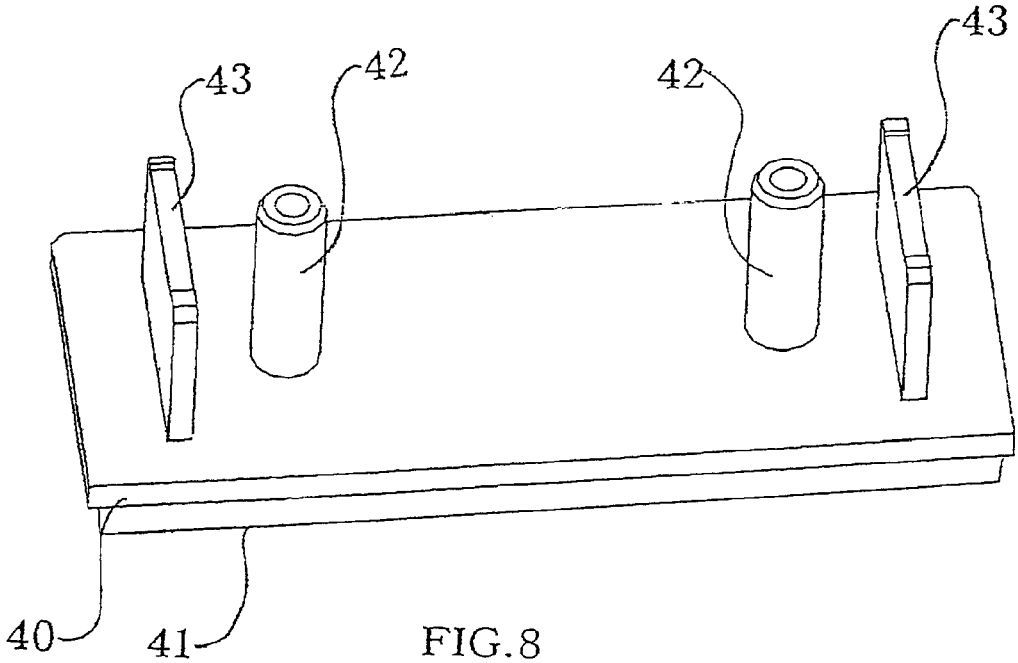

A significant advantage of the inventive construction can be seen from FIGS. 5 and 6. The new guidance and positioning of the refill 50 provides in the central area of the stock 10 space for a comparative large-surfaced stamp 41 with an associated stamp pad 61. The stamp 41 is secured to the stamp carrier 40 on the side facing the inside of the stock, which for its part is connected with the lid in the sleeve-shaped recess 22 of the lid 20 form fittingly engaging peg 42 with a lid is connected. The precise positioning and supporting of the stamp carrier 40 in regard to the lid 20 is provided by distancing or spacer tabs 23 of the lid 20 or as the case may be 43 of the stamp carrier 40 lying against each other. These details can be seen in greater detail from the perspective representation in FIGS. 7 and 8.

Figure 9:
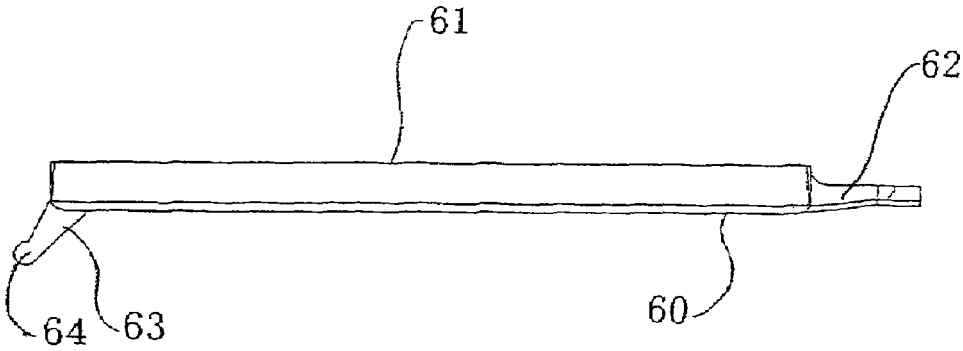
Figure 10:
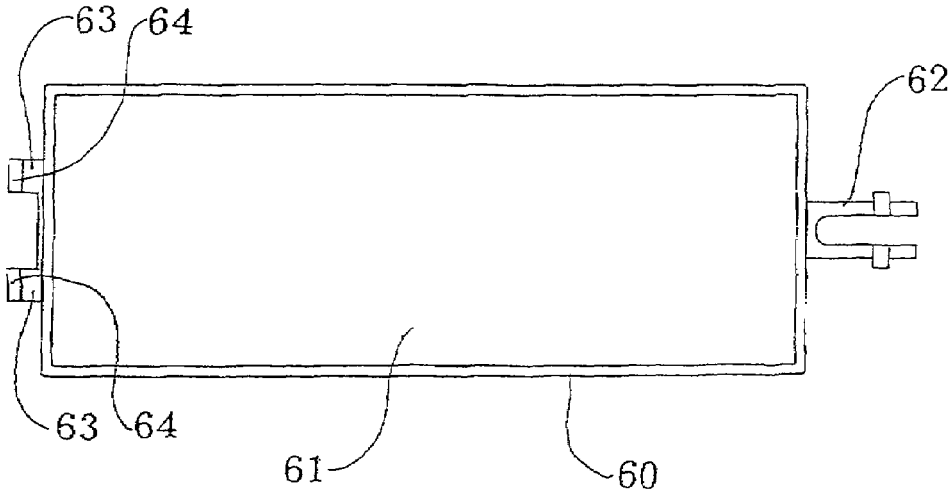

The releasable connection of stamp carrier 40 and lid 20 allows on the one hand a simple exchange of the stamp. On the other hand it is possible with the same writing instrument to realize various stamp techniques. Thus there can also be employed pre-impregnated stamps, so that in this case according to the type of the representation according to FIG. 6 the stamp pad can be completely dispensed with. To the extent that a stamp of the type with stamp pad is to be employed, then the embodiment of the stamp pad carrier 60 shown in FIGS. 9 and 10 is particularly suited. The stamp pad carrier 60, in the general shape of a basin and located approximately centrally in the hollow stock 10, receives the stamp pad 61 on it's inside. In its stock tip end it is provided with two arms 63, facing in the axial direction diagonally downwards, which engage with ends shaped as linkage heads 64, against bearing 19 in the inner side of the stock 10 in manner shown in FIG. 5. On its rear end the stamp carrier has spring arms 62, which are deployable in the transverse direction and in the case of seating in the stock engage behind stock cross beam 18. The lower side the stamp pad carrier 60 lies upon the side of the cross bar 15, whereby a bending through of the stamp pad carrier 60 is prevented and therewith a clean and even inking of the stamp 41 lying against the stamp pad 61 is ensured.

Figure 11:
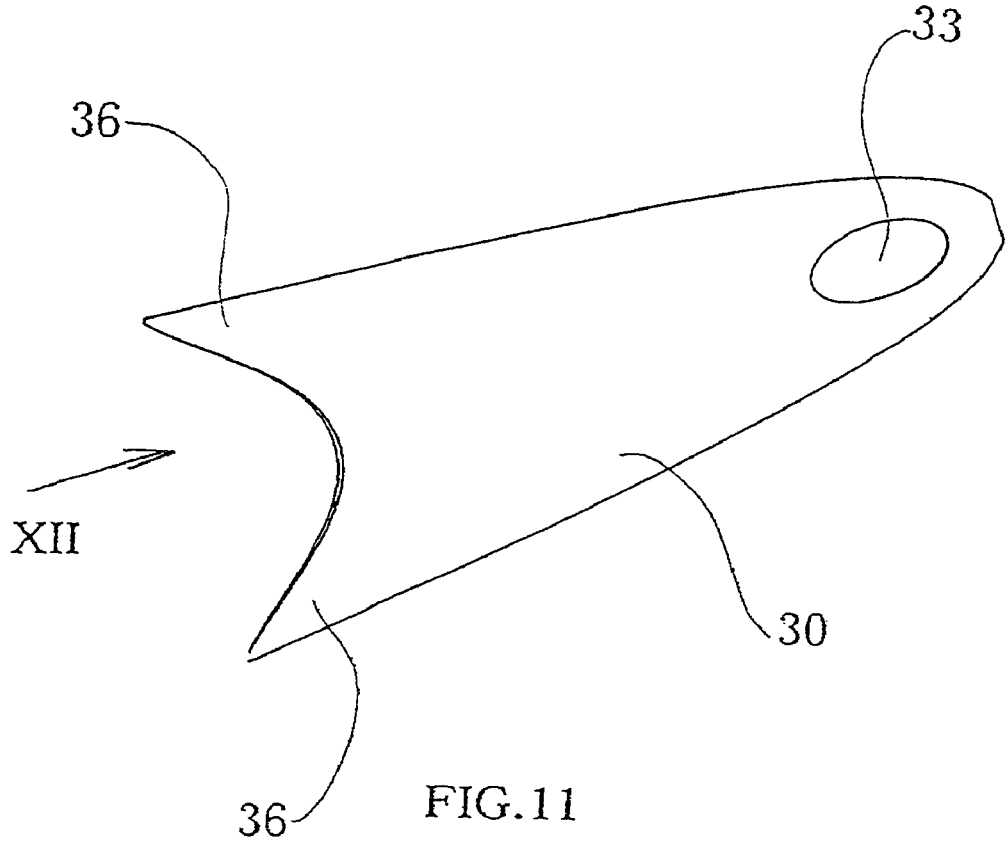
Figure 12:
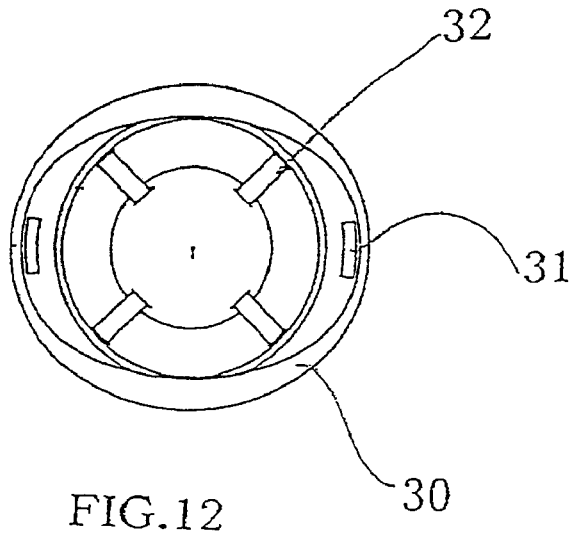
Figure 13:
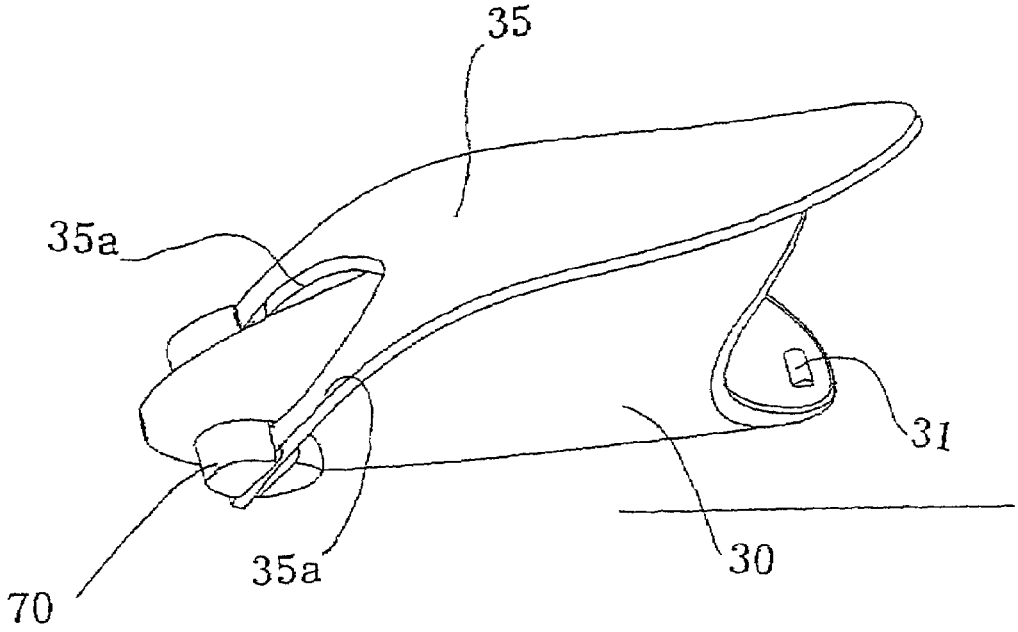
Figure 14:
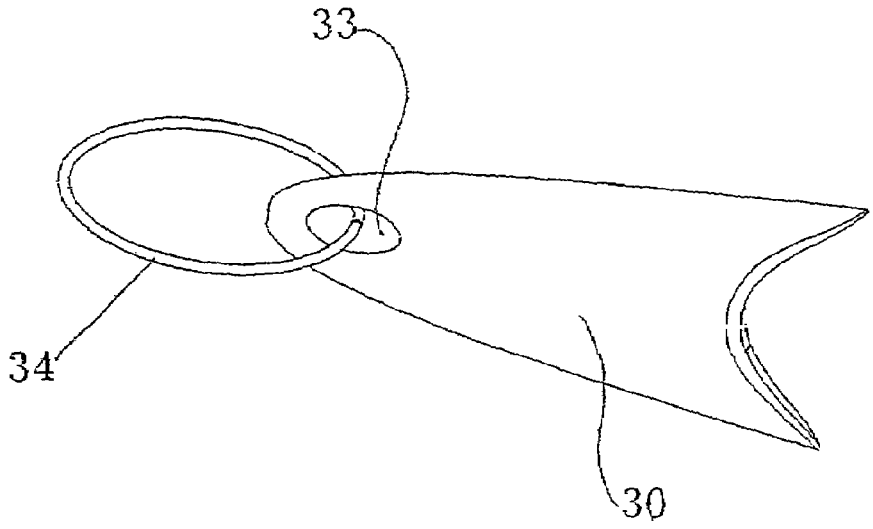

Three different embodiments of the cap 30 seatable upon the stock tip 12 are shown in FIGS. 11, 13 and 14. The approximately cone shaped cap 30 has on its outer end a securing eye 33 and terminates on its oppositely lying end in radially slightly spring-elastic sections 36. The axially running support ribs 32 provided inside the cap 30 lie, when the cap is seated upon the stock tip 12, in contact therewith. In the inner surface, radially to each other oppositely lying provided detent noses 31 engage under the influence of the spring sections 36 force- and form-fittingly for the positional securing of the cap 30 in the circumferentially running detent groove 11 of the stock 10.

The cap 30, with its securing eye 33, offers the two design possibilities represented in FIGS. 13 and 14.

According to FIG. 13 the cap 30 is equipped with a flexible retaining clip 35. This exhibits, at its shaft tip end, clip arms 35*a*, which carry a clip holder peg 70. Its central tab, not shown in the drawing, passes through the securing loop 33 and is non-rotatably seated therein.

The other, simpler, securing possibility can be seen from FIG. 14. Here a ring 34 in the shape of a key-ring is seated in the eye 33. By means of this ring the writing instrument can be secured to a chain or a string.

It is also possible that the eye 33 serves directly for securing to a string or a security cord, a so called "lanyard".

The essential advantage of the inventive writing device is comprised therein, that a large surface stamp can be integrated in a very compact stock with employment of economical refill cartridges with large ink or, as the case may be, paste storage volume.

Both stamps as well as stamp pads can be mounted and exchanged in simple manner.

The employment of various stamp techniques or technologies is possible.

The refill cartridge is guided and secured reliably without use of springs or mechanisms.

The cap is usable universally for various securing possibilities.

The large surface stock with the likewise quite large lid offers a large text surface, which is advantageous for advertisement purposes.

Besides this, the stock with the stamp insert is constructed easy to assemble, so that an economical and rapid assembling is possible.

REFERENCE NUMBER LIST

| | |
|---|---|
| 10 | Stock (housing) |
| 10a/10 b | Shell |

-continued

| REFERENCE NUMBER LIST | |
|---|---|
| 10c | Cylindrical seat |
| 11 | Detent groove |
| 12 | Stock tip |
| 13 | Lid receptacle |
| 13a | Edge of the lid receptacle |
| 14 | Detent receptacle |
| 15 | Cross piece |
| 16 | Receptacle area |
| 17 | Connecting sleeve |
| 17a | Connecting peg |
| 18 | Cross piece |
| 19 | Bearing |
| 20 | Lid |
| 21 | Sidewall |
| 22 | Sleeve-shaped receptacle |
| 23 | Spacer tab |
| 24 | Detent peg |
| 25 | Elastic lip |
| 30 | Cap |
| 31 | Detent nose |
| 32 | Support ribs |
| 33 | Securing eye |
| 34 | Ring |
| 35 | Retaining clip |
| 35a | Clip arm |
| 36 | Spring-elastic segment |
| 40 | Stamp carrier |
| 41 | Stamp |
| 42 | Journal peg |
| 43 | Distance bar |
| 50 | Refill |
| 51 | Refill tip |
| 53 | Guide bar |
| 54 | Abutment |
| 60 | Stamp pad carrier |
| 61 | Stamp pad |
| 62 | Spring arms |
| 63 | Arms |
| 64 | Linkage head |
| 70 | Clip holder peg |

The invention claimed is:

1. A handwriting instrument, comprising:

a hollow stock, in which a refill with co-axially provided refill tip and an approximately centrally located stamp pad carrier providing a stamp pad extending in the longitudinal direction as well as a stamp carrier with a stamp laying upon the stamp pad are provided seated laterally in the stock, wherein the stamp carrier with the stamp is removable from the stock via a handle, wherein the refill is comprised of a flexible material, and extends over essentially the entire length of the stock and, in the area of the approximately centrally located stamp pad carrier, is bent by a guide bar, positioned close to the refill tip, in the direction towards an inner wall of the stock, with the refill being supported in its position by cross bars arranged at intervals in the form of ribs.

2. The handwriting instrument according to claim 1, wherein the handle is a one-piece lid inserted into the stock and supplements the stock outline at the inner wall of which is provided for the stamp carrier with stamp.

3. The handwriting instrument according to claim 2, wherein the lid is a segment of the stock and a lateral recess of the stock corresponds to the dimensions of the lid and forms a lid recess, wherein sidewalls of the lid extend until an approximate center line of the stock.

4. The handwriting instrument according to claim 2, wherein on the lid a detent tab directed towards the inside of the stock is provided, which releasably engages in a detent recess receptacle of the stock.

5. The handwriting instrument according to claim 2, wherein the stamp carrier has pegs, which are releasably introduced into corresponding sleeve-shaped recess in the lid, wherein spacer bars are provided on the stamp carrier and/or the lid.

6. The handwriting instrument according to claim 1, wherein, on the inner wall of the stock, said cross bars in the form of ribs are spaced apart from each other and provide for lateral positional securing of the refill.

7. The handwriting instrument according to claim 1, wherein the stock is divided along the axial direction and is comprised of two shells, of which one has transverse running connecting sleeves located in the front and back area and the other has connecting pegs form fittingly engaging in the connecting sleeves, wherein the refill lies against the connecting sleeves outer surfaces.

8. The handwriting instrument according to claim 1, wherein the stock in the area of the refill tip has a cylindrical seat, upon which a stock tip is friction-fittingly seated.

9. The handwriting instrument according to claim 1, wherein the stamp pad carrier has on one end arms with linkage heads, which are introduced in the bearing of the stock, and on the opposite end has spring arms, which engage in cross beams of the stock.

10. The handwriting instrument according to claim 1, wherein a cap is seatable upon a stock tip, which on the outer end have a securing eye and on the oppositely lying end have radially spring-elastic detent noses, which releasably engage in circumferentially running detent grooves of the stock.

11. The handwriting instrument according to claim 10, wherein the cap has, on the end towards the stock, axially oriented, radially spring sections, on which the detent noses are formed.

12. The handwriting instrument according to claim 10, wherein a flexible retaining clip is secured to the cap, having clip arms at the securing eye end, which carry a peg extending through the securing eye, wherein the peg is connected with the clip arms and is non-rotatingly seated in the securing eye.

13. The handwriting instrument according to claim 10, wherein a ring is seated in the securing eye.

14. A handwriting instrument, comprising:

a hollow stock having a tip, a rear end, and an interior wall, a refill with refill tip provided co-axial through the stock tip, a stamp pad carrier providing a stamp pad extending in the longitudinal direction, located approximately centrally in the stock, and a stamp carrier with stamp laying upon the stamp pad seated laterally in the stock, wherein the stamp carrier with the stamp is removable from the stock via a handle, wherein the refill is comprised of a flexible material, and extends over essentially the entire length of the stock and in the area of the approximately centrally located stamp pad carrier is bent in the direction towards the inner wall of the stock, wherein the handle is a lid seated in the stock, on the inner side of which the stamp carrier with stamp is provided, wherein the inner wall of the stock includes cross bars in the form of ribs spaced apart from each other for the lateral positional securing of the refill.

15. The handwriting instrument according to claim 14, wherein the refill close to the refill tip lies against a deflecting guide bar deflecting the refill out of the center in the direction towards the inner wall of the stock.

16. The handwriting instrument according to claim 14, wherein the stock in the area of the refill tip has a cylindrical seat, upon which the stock tip is friction-fittingly seated.

17. The handwriting instrument according to claim 14, wherein on the lid a detent tab directed towards the inside of the stock is provided, which releasably engages in a detent recess of the stock.

18. A handwriting instrument, comprising:

a hollow stock having a tip, a rear end, and an interior wall, a refill with refill tip provided co-axial through the stock tip, a stamp pad carrier providing a stamp pad extending in the longitudinal direction, located approximately centrally in the stock, and a stamp carrier with stamp laying upon the stamp pad seated laterally in the stock, wherein the stamp carrier with the stamp is removable from the stock via a handle, wherein the refill is comprised of a flexible material, and extends over essentially the entire length of the stock and in the area of the approximately centrally located stamp pad carrier is bent in the direction towards the inner wall of the stock, wherein the handle is a lid seated in the stock, on the inner side of which the stamp carrier with stamp is provided, and wherein on the lid a detent tab directed towards the inside of the stock is provided, which releasably engages in a detent recess of the stock.

19. The handwriting instrument according to claim 18, wherein the refill close to the refill tip lies against a deflecting guide bar deflecting the refill out of the center in the direction towards the inner wall of the stock.

20. The handwriting instrument according to claim 18, wherein, on the inner wall of the stock, cross bars in the form of ribs spaced apart from each other are provided for the lateral positional securing of the refill.

* * * * *